US007294023B2

(12) United States Patent
Schneider

(10) Patent No.: US 7,294,023 B2
(45) Date of Patent: Nov. 13, 2007

(54) COAXIAL PLUG-AND-SOCKET CONNECTOR

(75) Inventor: Mario Schneider, Oberriet (CH)

(73) Assignee: Huber & Suhner AG, Herisau (CH)

( * ) Notice: Subject to any disclaimer, the term of this patent is extended or adjusted under 35 U.S.C. 154(b) by 0 days.

(21) Appl. No.: 10/570,694

(22) PCT Filed: Jun. 21, 2004

(86) PCT No.: PCT/CH2004/000376

§ 371 (c)(1),
(2), (4) Date: Mar. 3, 2006

(87) PCT Pub. No.: WO2005/027275

PCT Pub. Date: Mar. 24, 2005

(65) Prior Publication Data

US 2006/0264098 A1 Nov. 23, 2006

(30) Foreign Application Priority Data

Sep. 17, 2003 (CH) ..... 1590/03

(51) Int. Cl.
*H01R 24/00* (2006.01)

(52) U.S. Cl. ..... 439/675

(58) Field of Classification Search ..... 439/349, 439/675, 609, 827, 843, 578
See application file for complete search history.

(56) References Cited

U.S. PATENT DOCUMENTS 4,673,236 A * 6/1987 Musolff et al. ..... 439/609
4,929,188 A * 5/1990 Lionetto et al. ..... 439/349
5,938,465 A 8/1999 Fox, Sr.
6,783,406 B2 * 8/2004 Keiser et al. ..... 439/827

FOREIGN PATENT DOCUMENTS

| | | |
|---|---|---|
| DE | 72 47 486 | 3/1973 |
| DE | 38 14 069 C1 | 6/1989 |
| DE | 196 18 026 A1 | 11/1997 |
| DE | 199 09 107 A1 | 9/2000 |

* cited by examiner

*Primary Examiner*—Phuong Dinh
(74) *Attorney, Agent, or Firm*—The Webb Law Firm

(57) ABSTRACT

The coaxial plug-and-socket connector is for high frequencies, particularly in the GHz range, and comprises a socket part and a plug part as well as an elastic electrical contact element. The contact element connects the outer conductor of the socket part to the outer conductor of the plug part and is placed between the plug part and the socket part. The contact element comprises a number of elastic parts that, while under radial elastic stress, form a contact point to the outer conductor of the socket part and a contact point to the outer conductor of the plug part. Said contact points preferably lie in a plane running perpendicular to the longitudinal axis of the plug-and-socket connector and near a face of the plug part. The connector is stable up to approximately 65 GHz.

17 Claims, 4 Drawing Sheets

COAXIAL PLUG-AND-SOCKET CONNECTOR

The invention relates to a coaxial plug-and-socket connector for high frequencies, in particular in the millimeter waveband, having a socket part and a plug part and having a spring-elastic electrical contact element, which radially connects the outer conductor of the socket part to the outer conductor of the plug part and is arranged between the plug part and the socket part.

A plug-and-socket connector of the type mentioned has been disclosed in DE 38 14 069C. This plug-and-socket connector has an embossed and divided contact spring strip, which is inserted into an annular groove in the socket part or the plug part. The contact spring strip should maintain its radially resilient properties on the outside owing to it being embossed. The base surface of the groove follows the bending line of the contact spring strip in the stretched state. The contact spring strip is divided into laminated springs by means of numerous slots, said laminated springs likewise being embossed and each being connected to one another at their ends via an edge. At very high frequencies and, in particular, at frequencies above 6 GHz, this connector is unstable, however.

DE 195 36 276 A and U.S. Pat. No. 5,938,465 have also disclosed coaxial MMCX plug-and-socket connectors.

Figure 8A:
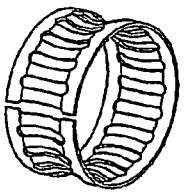
Figure 8B:
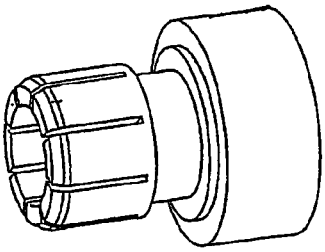

In addition, the radial contact elements shown in FIGS. 8*a* and 8*b* have been disclosed in the prior art. The radial contact element shown in FIG. 8*a* is in the form of a basket and largely corresponds to that in accordance with the abovementioned DE 38 14 069 C. This contact element can also not ensure the required stability above approximately 6 GHz. The slotted and resilient outer conductor shown in FIG. 8*b* likewise does not meet the requirements mentioned. The mechanical stability as regards the bending moment is thus insufficient in these cases.

Numerous connectors are also known in the case of which an axial contact element is intended to ensure the electrical contact between the plug part and the socket part. Known in particular are the wave washer in FIG. 7*a*, the slotted plate spring shown in FIG. 7*b* and the multi-step electroformed part shown in FIG. 7*c*. Unslotted plate springs are also known. With these axial contact elements there is the difficulty that a comparatively high axial force needs to be maintained. In the case of screw connectors, this can be achieved easily. In the case of quick-fit couplings, so-called "push-pull" connectors having a larger design, this can likewise be achieved by suitable design measures. Connectors having a quick-fit coupling and a small outer diameter of, for example, 2 mm can, however, barely ensure the required axial stressing forces in design terms with a reasonable degree of complexity.

The invention is based on the object of providing a plug-and-socket connector of the mentioned type which is stable at very high frequencies and in particular at frequencies above 6 GHz.

The object is achieved in the case of a generic coaxial plug-and-socket connector by the fact that the contact element has a plurality of spring-elastic parts, which each form, under radial spring-elastic stress, a contact point to the outer conductor of the socket part and a contact point to the outer conductor of the plug part. With the plug-and-socket connector according to the invention, each spring-elastic part forms, under stress, a contact point to the outer conductor of the socket part and a contact point to the plug part.

Measurements have shown that, as a result, resonances can be shifted upwards and in particular to above 6 GHz, and it is thus possible to achieve a high degree of stability. It is possible to dispense with an axial contact, with the result that, even in the case of very small dimensions of a few millimeters, it is possible to implement a simple plug-and-socket coupling which can be operated in a reliable manner. The plug-and-socket connector according to the invention can also be coupled with the known MMCX connectors.

Particularly high stability results when, in accordance with one development of the invention, the contact points lie in a plane which runs perpendicularly with respect to the longitudinal axis of the plug-and-socket connector and close to a front end of the plug part.

The contact element can be realized in a particularly cost-effective manner when, in accordance with one development of the invention, said contact element is in the form of a crown and in particular has a plurality of axially extending slots which are open at one end. The contact element can in this case be formed from a corresponding tube section.

One development of the invention provides for the spring-elastic parts to be tabs which are each rotated about their longitudinal axis. The contact element can also be designed to be in the form of a sleeve-shaped part having very small dimensions of a few millimeters.

Measurements have shown that the plug-and-socket connector is stable up to approximately 65 GHz when, in accordance with one development of the invention, the contact element has more than 6, preferably 8-12 and in particular 10 spring-elastic parts.

The contact element is preferably mounted in a groove in the socket part. The plug part is inserted into the contact element during coupling. The spring-elastic parts extend in the axial direction of the insertion direction of the plug part and are tensioned radially outwards when the plug part is inserted. Damage to the contact element is avoided even if the two connector parts are plugged together eccentrically.

Further advantageous features result from the dependent patent claims, the description below and the drawing.

Figure 1:
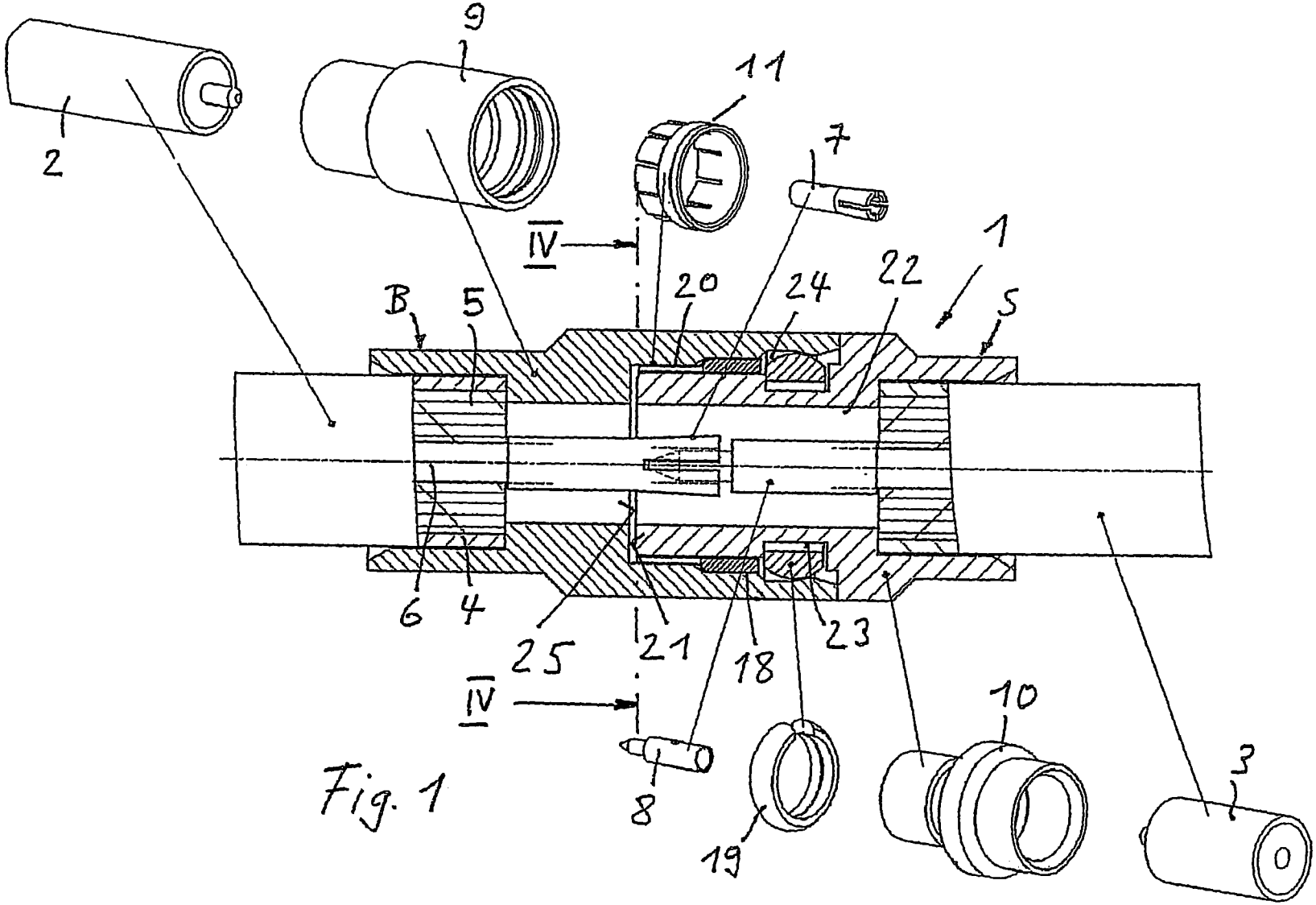
Figure 2:
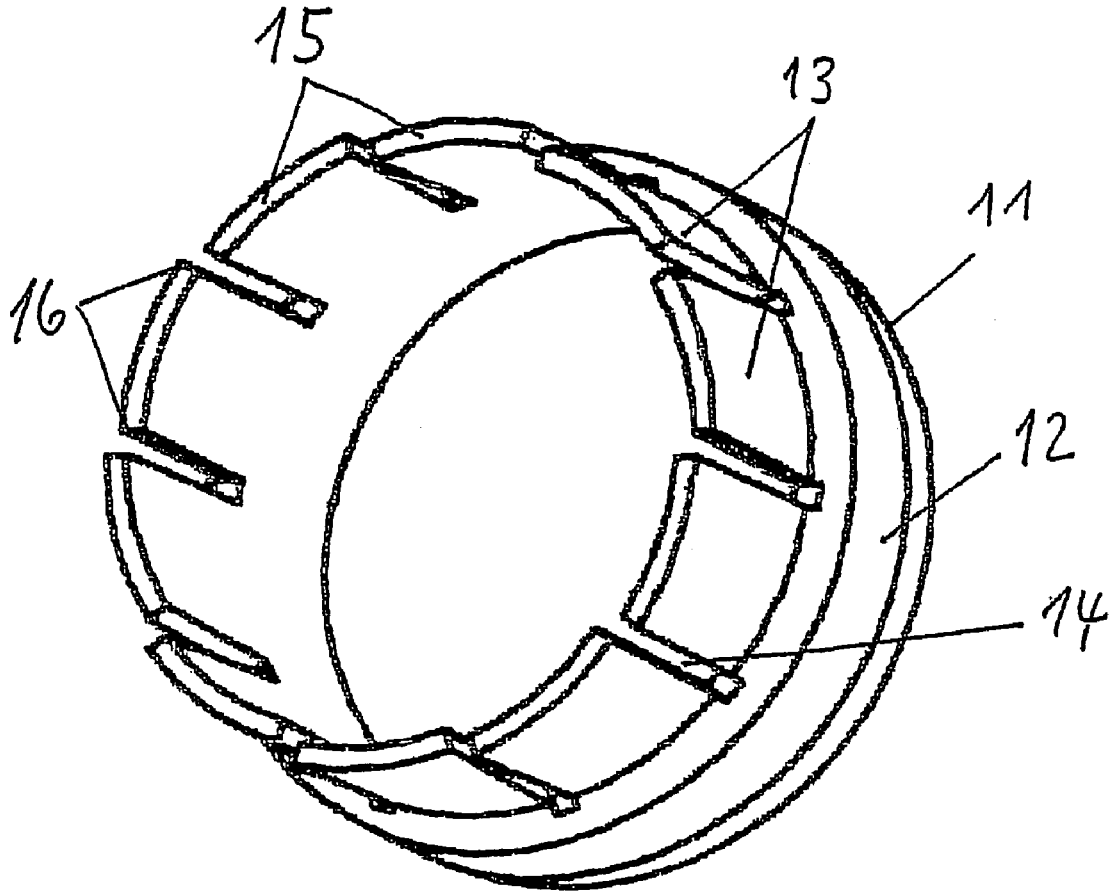
Figure 3:
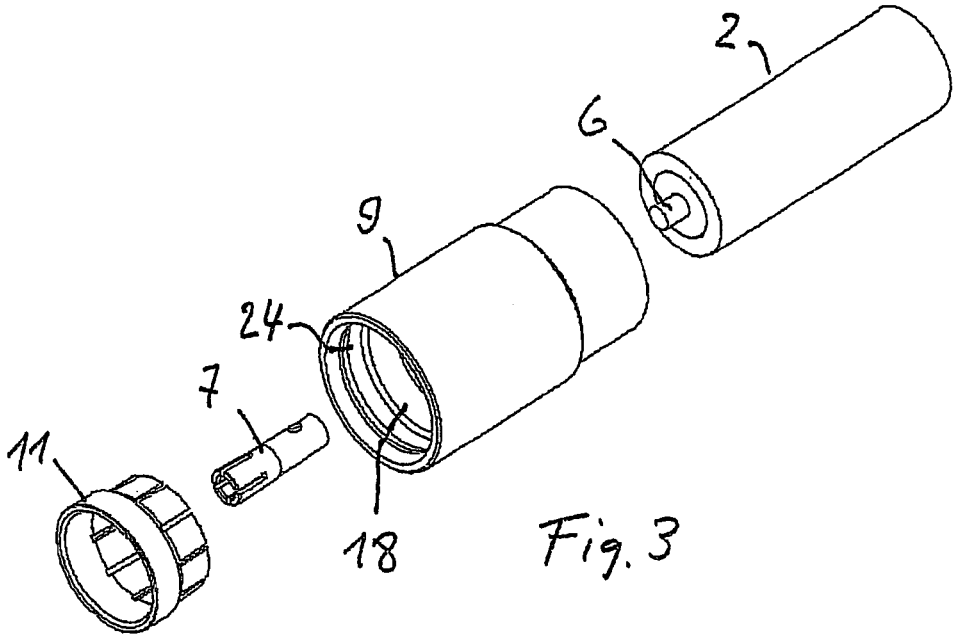
Figure 4:
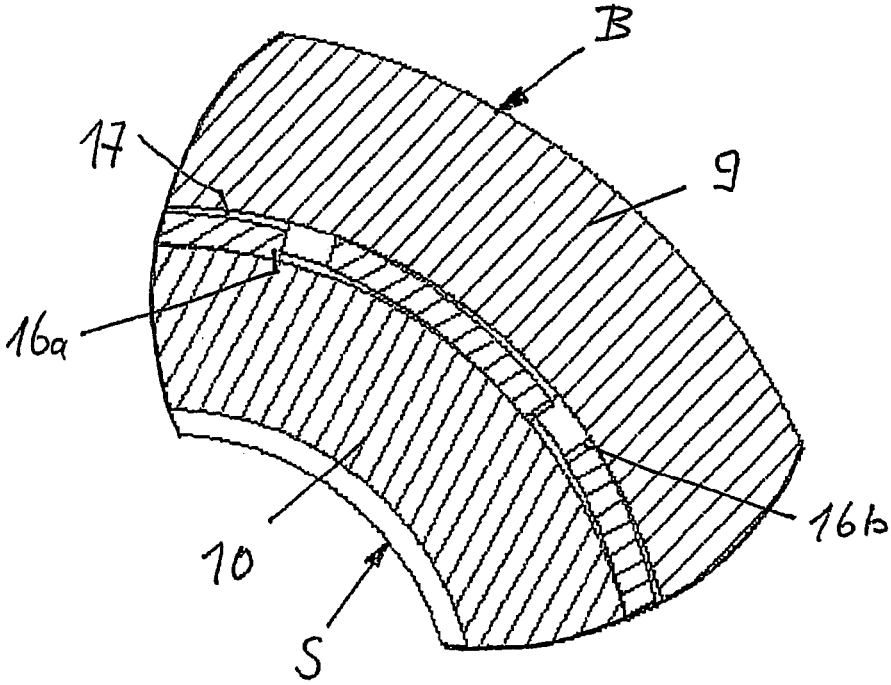
Figure 5:
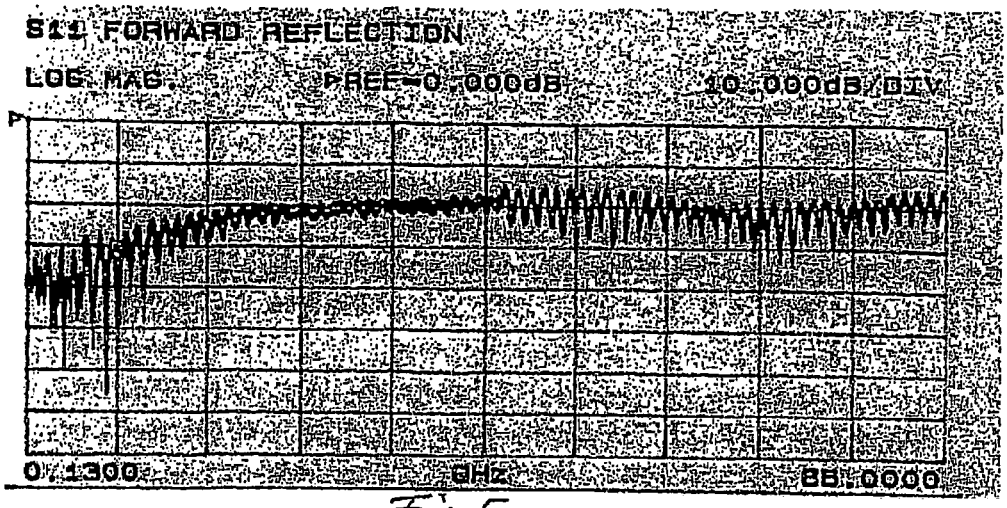
Figure 6:
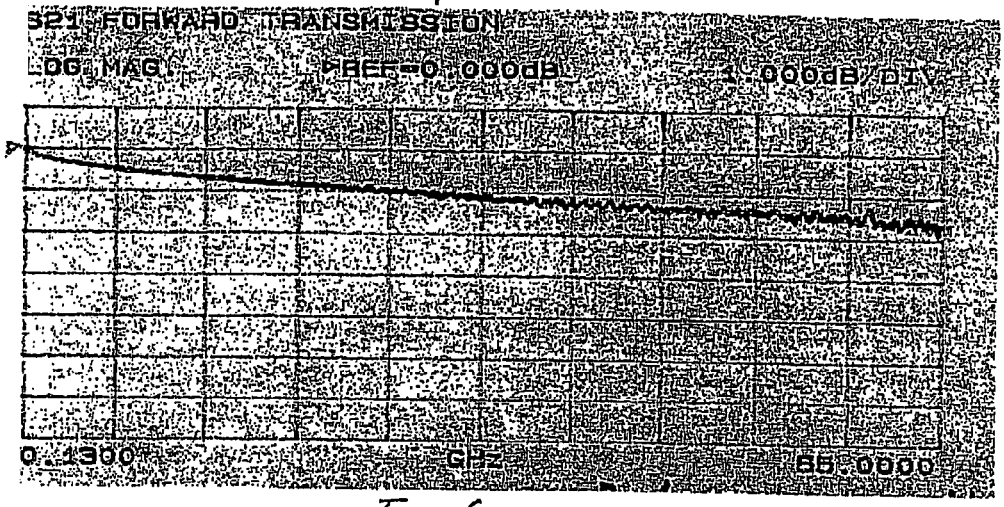
Figure 7A:
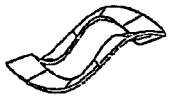
Figure 7B:
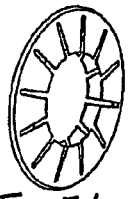
Figure 7C:
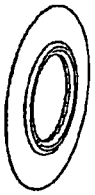

One exemplary embodiment of the invention will be explained in more detail below with reference to the drawing, in which:

FIG. 1 shows a longitudinal section through a connector according to the invention, in which case the individual parts are also shown in a three-dimensional view, FIG. 2 shows a three-dimensional view of a contact element on a severely enlarged scale, FIG. 3 shows a three-dimensional view of the socket part, in which case the individual parts are disassembled, FIG. 4 shows a cross section through the connector along the line IV-IV in FIG. 1, FIGS. 5 and 6 show measurement curves for the reflection property (FIG. 5) and the transmission properties (FIG. 6) of the connector according to the invention, FIGS. 7*a* to 7*c* show axial contact elements in accordance with the prior art, and FIGS. 8*a* and 8*b* show radial contact elements in accordance with the prior art.

The coaxial connector 1 shown in FIG. 1 is a plug-and-socket connector, also referred to as a "push-pull" connector, which can be joined, in contrast to a screw connector, without a screwing operation. A socket part has a housing part 9, which forms an outer conductor and is connected to a coaxial cable 2. The coaxial cable 2 has a conventional outer conductor 4, which is conductively connected to the housing part 9. An inner conductor 6 is separated from the outer conductor 4 by a dielectric 5 and is electrically connected to a spring socket 7. The spring socket 7 extends in the longitudinal direction of a stepped hole 20, which has a shoulder 21.

The socket part B is coupled to a plug part S, which has a housing part 10 having a through-hole 22 and likewise forms an outer conductor. The housing part 10 is connected to a coaxial cable 3, which may have the same design as the cable 2. A plug pin 8 connects the inner conductor of the cable 3 to the inner conductor of the cable 2. The plug pin 8 and the spring socket 7 can be designed as known per se.

A circumferential groove 23 is incorporated into the cylindrical outer side of the housing part 10, a snap-action ring 19 being mounted in said circumferential groove 23 and interacting with an inclined surface 24 of the housing 9 so as to be secured axially. The snap-action ring 19 is slotted and is inserted into the groove 23 such that it is compressed radially when the parts S and B are coupled. If the socket part B and the plug part S are plugged together axially, the snap-action ring 19 latches into the depression formed by the inclined surface 24 and latches the two parts S and B in the coupled position shown in FIG. 1. Owing to the inclined surface 24, an axial stress is produced which holds the two parts S and B in the position shown counter to a corresponding separating force. In order to detach the connector, the two parts B and S are pulled apart from one another axially, the snap-action ring 19 in turn being compressed radially.

When viewed in the insertion direction of the plug part S, a flat groove 18, which is open at one end, is incorporated into the housing part 9 after the surface 24, as can be seen in FIG. 3. This groove 18 serves the purpose of mounting a contact element 11, which forms a closed sleeve in the form of a crown, as shown in FIG. 2. The contact element 11 is produced from a conductive material, in particular a spring-elastic metal, and has a circumferential holding ring 12, which is inserted into the groove 18, as shown in FIG. 1. A plurality of and in particular ten tabs 13 are integrally formed on this holding ring 12 and are each separated from one another by an open slot 14. These tabs 13 are each rotated about their longitudinal axis through a comparatively small angle.

The tabs 13 each have an end face 15, said end faces lying in a plane which extends perpendicularly with respect to the longitudinal direction of the plug-and-socket connector 1 and runs directly behind an end face 25 of the housing part 10. The tabs 13 are located in an intermediate space 17, which is slightly wider than the wall thickness of the tabs 13. The tabs 13 are rotated such that they each form a contact point to the housing part 9 with an outer corner 16*b* and a contact point to the housing part 10 with an inner corner 16*a*, as shown in FIG. 4. The contact element 11 thus forms a plurality of radial and punctiform contact points 16*b* to the housing part 9 and a plurality of radial and punctiform contact points to the housing part 10, said contact points being maintained owing to the spring-elastic stresses of the tabs 13 even when the connector 2 is bent or is wrenched at the two parts B and S. Owing to the stresses of the tabs 13, differences in tolerances in the width of the intermediate space 17 can also be accommodated. The two housing parts 9 and 10 are preferably unslotted and are thus closed, as a result of which a particularly high bending moment can be accommodated.

The slots 14 are open at one end, as mentioned above, and have a comparatively short length; in particular this length is less than 1.7 mm, preferably 1.1 mm. The tabs 13 are thus comparatively sensitive parts which should not be damaged during coupling. Since the plug part S or the housing part 10 is inserted into the contact element 11 in the direction of extent of the tabs 13, the tabs 13 cannot be damaged even when the two parts B and S are plugged together eccentrically. Even when detaching the connector, damage to the tabs 13 is largely ruled out.

Measurements in accordance with FIGS. 5 and 6 have shown stability up to 65 GHz. A connector according to the invention having in each case 13 cm long "semi-rigid" cables 2 and 3, which were in each case soldered to the socket part B and the plug part S, respectively, was used in the measurements. For measurement purposes, the two cables 2 and 3 were screwed to the measurement point and coupled to one another. The measurement was carried out using a vectorial network analyzer.

Measurements were taken firstly of the return loss (S11 forward reflection), as shown in FIG. 5, and secondly of the insertion loss (S21 forward transmission), as shown in FIG. 6. Measurements were taken in the frequency range of 0.13 to 65 GHz. During the measurements, the connector was bent and wrenched. The return loss is the logarithmic ratio between the reflected power and the input power in dB. A reflectionless line has an RL of minus infinity dB, but a short circuit has an RL of 0 dB. The insertion loss is the logarithmic ratio between the transmitted power and the input power in dB. A lossless line has an insertion loss of 0 dB and a short-circuited line has an insertion loss of minus infinity dB. In the measurements shown in FIGS. 5 and 6, in each case only the amplitude is illustrated. The measurements show, in particular, that even bending and wrenching the connector parts or the cables does not result in any substantial and disruptive reflections at a frequency of less than 65 GHz.

LIST OF REFERENCES

1. Connector
2. Coaxial cable
3. Coaxial cable
4. Outer conductor
5. Dielectric
6. Inner conductor
7. Spring socket
8. Plug pin
9. Housing part
10. Housing part
11. Contact element
12. Holding ring
13. Tabs
14. Slots
15. End sides
16. Corners
17. Intermediate space
18. Groove
19. Snap-action ring
20. Stepped hole
21. Shoulder
22. Through-hole
23. Groove
24. Surface
25. End face
B Socket part
S Plug part

The invention claimed is:

1. A coaxial plug-and-socket connector for high frequencies comprising a socket part; a plug part; and a spring-elastic electrical contact element radially connecting an outer conductor of the socket part to an outer conductor of the plug part, the spring-elastic electrical contact element arranged between the plug part and the socket part, wherein the contact element has a plurality of spring-elastic parts, each of the plurality of spring-elastic parts forming a contact point to the outer conductor of the socket part and a contact point to the outer conductor of the plug part under radial spring-elastic stress, wherein the contact points lie in a plane which runs perpendicularly with respect to a longitudinal axis of the plug-and-socket connector and close to an end face of the plug part.

2. The plug-and-socket connector as claimed in claim 1, wherein the contact element is in the form of a crown.

3. The plug-and-socket connector as claimed in claim 1, wherein the contact element has a plurality of axially extending slots which are open at one end.

4. The plug-and-socket connector as claimed in claim 3, wherein the spring-elastic parts are each formed by two slots.

5. The plug-and-socket connector as claimed in claim 1, wherein the spring-elastic parts are tabs which are each rotated about a longitudinal axis through a comparatively small angle.

6. The plug-and-socket connector as claimed in claim 5, wherein two outer corners of the tabs, which are arranged at a distance from one another, form contact points, the contact points are a contact point to a housing part of the plug part and a contact point to a housing part of the socket part.

7. The plug-and-socket connector as claimed in claim 1, wherein the contact element has more than six spring-elastic parts.

8. The plug-and-socket connector as claimed in claim 1, wherein the contact element has a circumferential holding ring at one end, the spring-elastic parts being integrally formed on the holding ring, and the holding ring engaging in a groove in the socket part.

9. The plug-and-socket connector as claimed in claim 1, wherein the spring-elastic parts have a length of at most about 1.7 mm.

10. The plug-and-socket connector as claimed in claim 1, wherein a snap-action element is mounted on at least one of the plug part and the socket part and is arranged in front of the contact element when viewed in an insertion direction of the plug part.

11. The plug-and-socket connector as claimed in claim 1, wherein the spring-elastic parts extend axially from a holding ring approximately up to an end face of the plug part in an insertion direction of the plug part.

12. The plug-and-socket connector as claimed in claim 1, wherein at least one of the socket part and the plug part has a closed, unslotted housing part.

13. The plug-and-socket connector as claimed in claim 1, wherein the plug-and-socket connector is adapted to be coupled with MMCX connectors.

14. The plug-and-socket connector as claimed in claim 7, wherein the contact element has eight to twelve spring-elastic parts.

15. The plug-and-socket connector as claimed in claim 14, wherein the contact element has ten spring-elastic parts.

16. The plug-and-socket connector as claimed in claim 9, Wherein the spring-elastic parts have a length of 1.1 mm.

17. The plug-and-socket connector as claimed in claim 1, wherein the high frequencies are in the millimeter wave-band.

* * * * *